US007413487B1

(12) United States Patent
Chen

(10) Patent No.: US 7,413,487 B1
(45) Date of Patent: Aug. 19, 2008

(54) SIGNAL LINE CONNECTOR

(75) Inventor: Michael C. H. Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 11/732,246

(22) Filed: Apr. 3, 2007

(51) Int. Cl.
*H01R 4/36* (2006.01)

(52) U.S. Cl. ..... 439/811; 439/817; 439/709

(58) Field of Classification Search ..... 439/817, 439/816, 811, 797, 709, 727, 728, 557
See application file for complete search history.

(56) References Cited

U.S. PATENT DOCUMENTS 3,246,283 A * 4/1966 Huska ..... 439/716
3,304,392 A * 2/1967 Isler ..... 337/152
3,539,977 A * 11/1970 Woertz ..... 439/811
4,004,846 A * 1/1977 Woertz ..... 439/724
4,040,712 A * 8/1977 Dahlstrom ..... 439/691
4,907,989 A * 3/1990 Huska ..... 439/812
5,030,139 A * 7/1991 Huska ..... 439/513
6,004,167 A * 12/1999 Hirakawa ..... 439/811
6,475,038 B1 * 11/2002 Franck ..... 439/811

* cited by examiner

*Primary Examiner*—Hien Vu
(74) *Attorney, Agent, or Firm*—Morris Manning Martin LLP; Tim Tingkang Xia, Esq.

(57) ABSTRACT

A signal line connector for electrically connecting two signal lines is provided. The signal line connector includes a base, a conductive element, and two pressing elements. The base has two sockets, allowing terminals of the signal lines to be inserted into the base. The conductive element is embedded in the base, and two ends of the conductive element are respectively corresponding to the sockets. The two pressing elements are movably disposed in the base, and are respectively corresponding to the sockets. The pressing elements press against the terminals of the signal lines to the conductive element at a clamping position, so as to electrically connect the signal lines to the conductive element. Or, the pressing elements separate the terminals of the two signal lines from the conductive element at a release position.

3 Claims, 12 Drawing Sheets

SIGNAL LINE CONNECTOR

BACKGROUND OF THE INVENTION

1. Field of Invention

The present invention relates to a device for connecting conductive parts, and more particularly, to a signal line connector which facilitates the wiring of signal output terminals.

2. Related Art

Currently, a normal sound source signal connector is a circuit that is connected to a circuit board 20 of a main audio unit 10, and audio cables 11 of speakers 12 are inserted into the sound source signal connector. As shown in FIGS. 1 and 2, the connector 30 is fixedly soldered onto a side of the circuit board 20 of the main audio unit 10, and has a plurality of leads 31. An end of each of the leads 31 extends outside the connector 30, and a part of each of the leads 31 is disposed in the connector 30. The other side of the connector 30 has a plurality of slots 33 corresponding to the leads 31, and the end of each of the leads 31 inside the connector 30 is in one of the slots 33. The exposed end of each of the leads 31 of the connector 30 is electrically connected to the circuit board 20 by means of soldering, such that the side having the slots 33 of the connector 30 is exposed outside the main audio unit 10. In addition, the connector 30 has a plurality of screw connection elements 32 exposed outside the main audio unit 10. The screw connection elements 32 are corresponding to the leads 31, and are located at one end of the slots 33. Each of the screw connection elements 32 can be a combination of a screw and a metal pad, and the metal pad is driven by the screw to move towards a side of the leads 31. The terminals of the audio cables 11 are inserted into the connector 30 through the slots 33, and overlap the leads 31. The screw connection elements 32 make the terminals of the audio cables 11 to tightly contact the leads 31, such that the audio cables 11 are electrically connected to the circuit board 20. Thus, the main audio unit 10 can output sound source signals to the speakers 12 via the audio cables 11.

However, though this design can rapidly install or remove the audio cables 11 of the speakers 12, the connector 30 is fixedly soldered on the circuit board 20 of the main audio unit 10. Therefore, when the speakers 12 are connected to the main audio unit 10 with long audio cables 11, considering the subsequent requirement to uninstall and store the speakers 12, if the audio cables connected to the speakers 12 are placed in pipeline channels in the walls of a building, the installation and the subsequent disconnection of the speakers 12 will be very complicated. Therefore, as the connector 30 is fixedly soldered on the circuit board 20 of the main audio unit 10, the position that the connector 30 is disposed on the main audio unit 10 is limited, and cannot be changed freely. Thus, the flexibility of the design of the main audio unit 10 and the circuit board 20 is limited.

SUMMARY OF THE INVENTION

The sound source signal connector of the prior art is fixedly soldered to the circuit board of the main audio unit, so the flexibility is limited, and the construction is difficult. In view of the above, the present invention provides a signal line connector, which has wire connecting parts with high flexibility, so as to enhance the tolerance of the design of signal input and output terminals, and improves the convenience of the construction.

In order to achieve the aforementioned object, the present invention provides a signal line connector, for electrically connecting two signal lines, so as to facilitate the relay connection of electrical signals between the signal lines. The signal line connector includes a base, a conductive element, and two pressing elements. The base has two sockets, allowing terminals of the signal lines to be inserted into the base. The conductive element is embedded in the base, and two ends of the conductive element are corresponding to the sockets. The two pressing elements are movably disposed in the base, and are corresponding to the sockets. The pressing elements press against the terminals of the signal lines on the conductive element at a clamping position, so as to electrically connect the signal lines and the conductive element. Or the pressing elements separate the terminals of the two signal lines from the conductive element at a release position. Thus, the electrical signals of the two signal lines can be transmitted to one another through the signal line connector.

The effect of the present invention is that the output terminals and input terminals of the signal line connector are fixed and connected with the pressing elements, so the connector does not need to be soldered and fixed to a specific position. Thus, the tolerance of the design of internal arrangement in the sound source output device is improved, and the signal lines laid in the pipeline channels in the wall of a building in advance can be utilized. Therefore, the sound source output terminals have fine flexibility, complicated wires exposed in the room are reduced, and the convenience to install and disconnect the sound source output device subsequently is improved as well.

The detailed features and advantages of the present invention will be described in detail in the following embodiments. Those skilled in the arts can easily understand and implement the content of the present invention. Furthermore, the relative objectives and advantages of the present invention are apparent to those skilled in the arts with reference to the content disclosed in the specification, claims, and drawings.

The above description of the content of the present invention and the following illustration of the embodiments are intended to demonstrate and explain the principle of the present invention and to provide further explanations of the claims of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
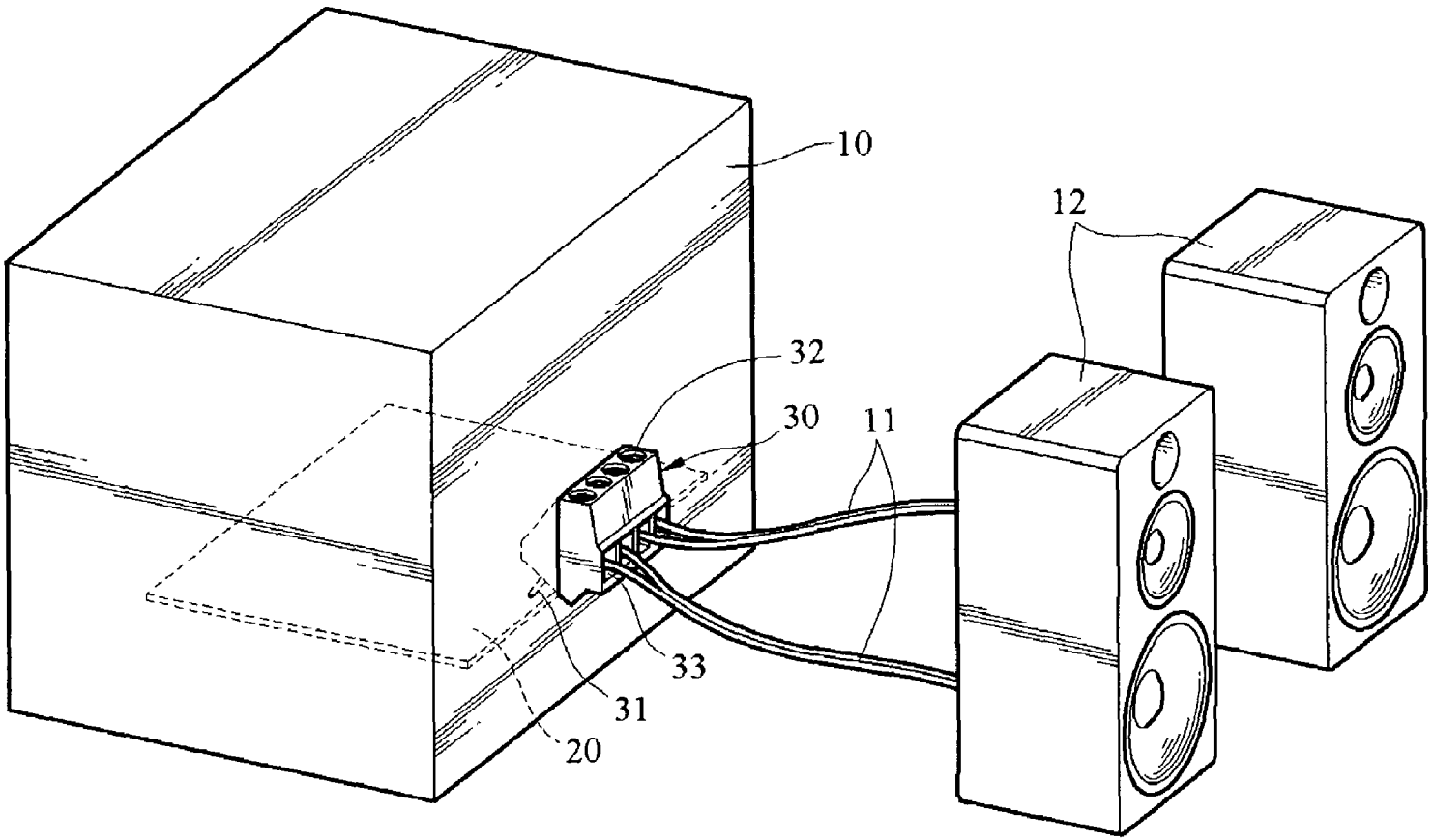
FIG.1(CONVENTIONAL ART)
FIG. 1 is a schematic view of a conventional sound source signal disposed on a main audio unit.
Figure 2:
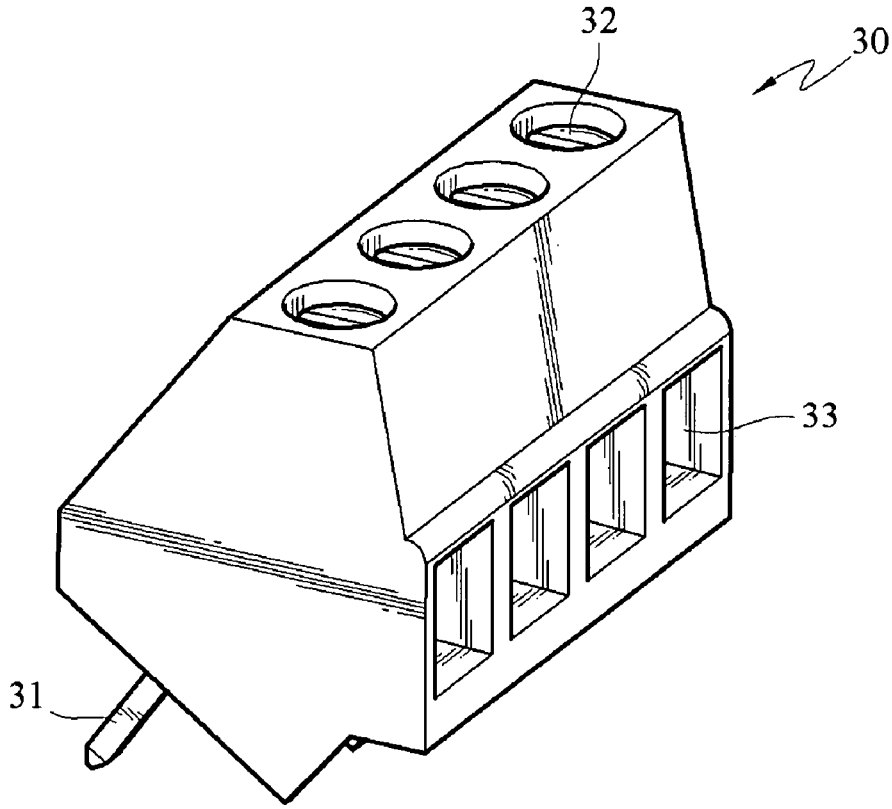
FIG.2(CONVENTIONAL ART)
FIG. 2 is a schematic isometric view of the conventional sound source signal connector.
Figure 3:
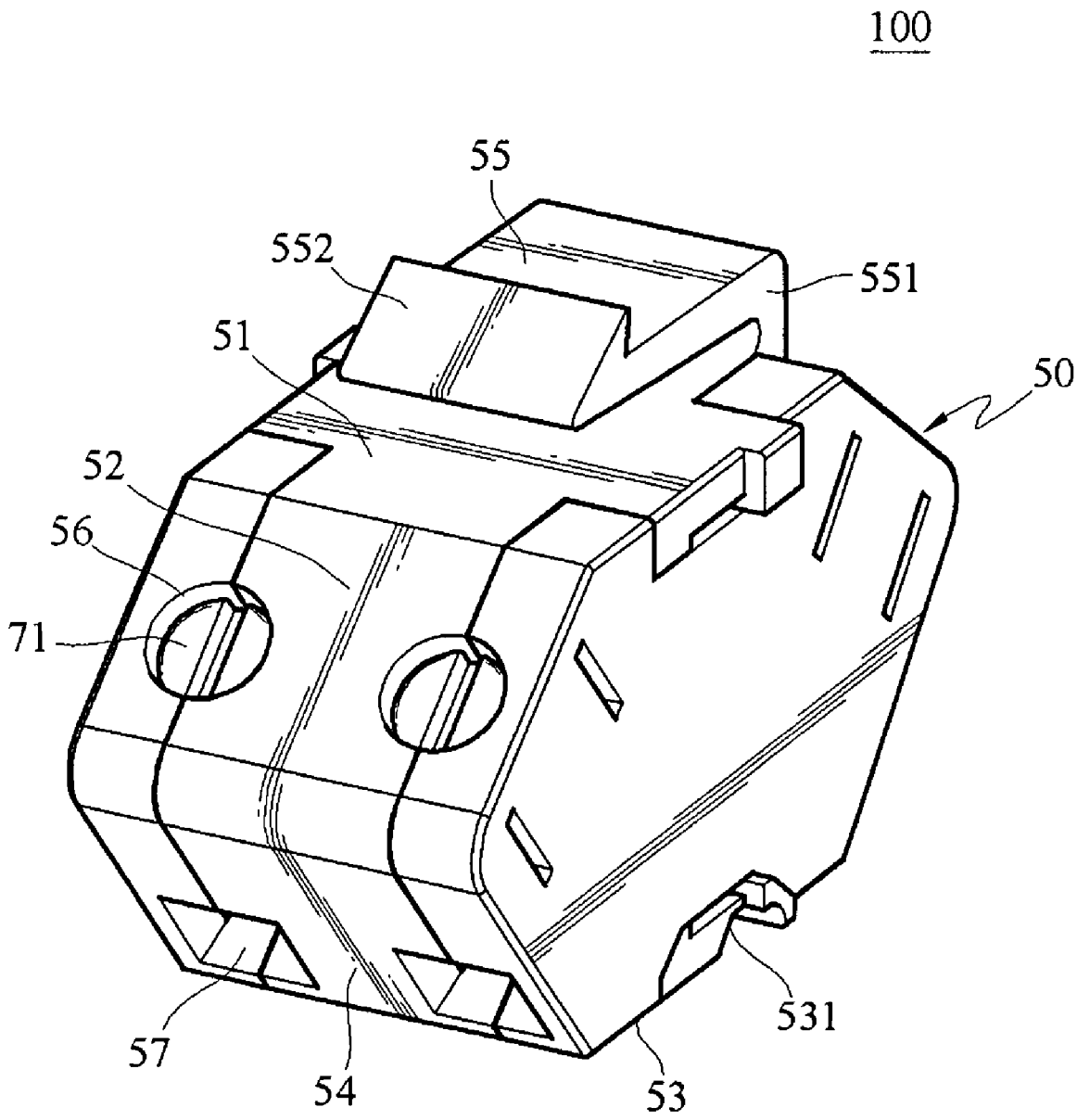
FIG. 3 is a schematic isometric view of a first embodiment of the present invention.
Figure 4:
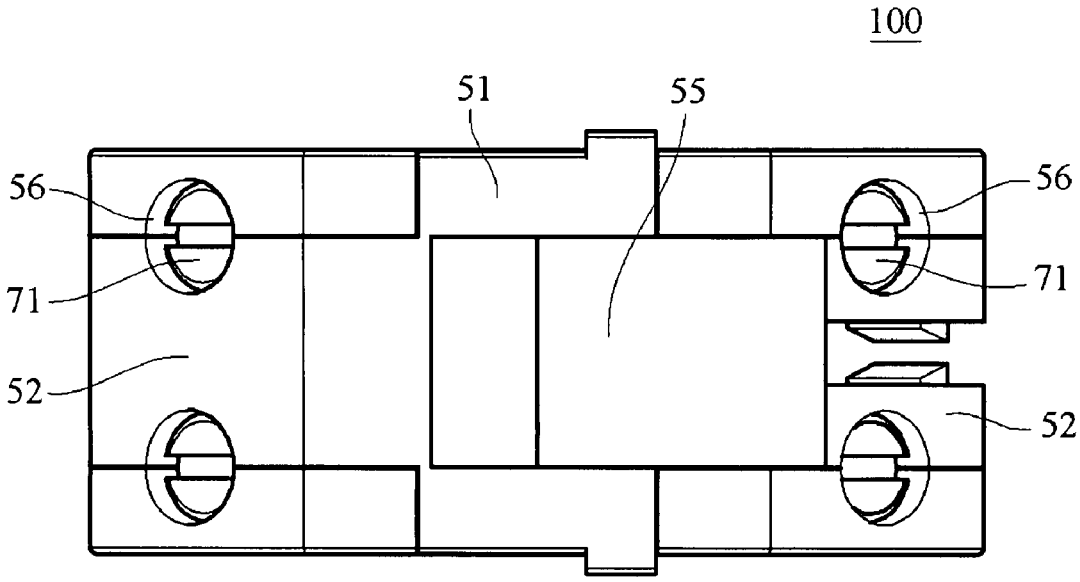
FIG. 4 is a top view of FIG. 3.
Figure 5:
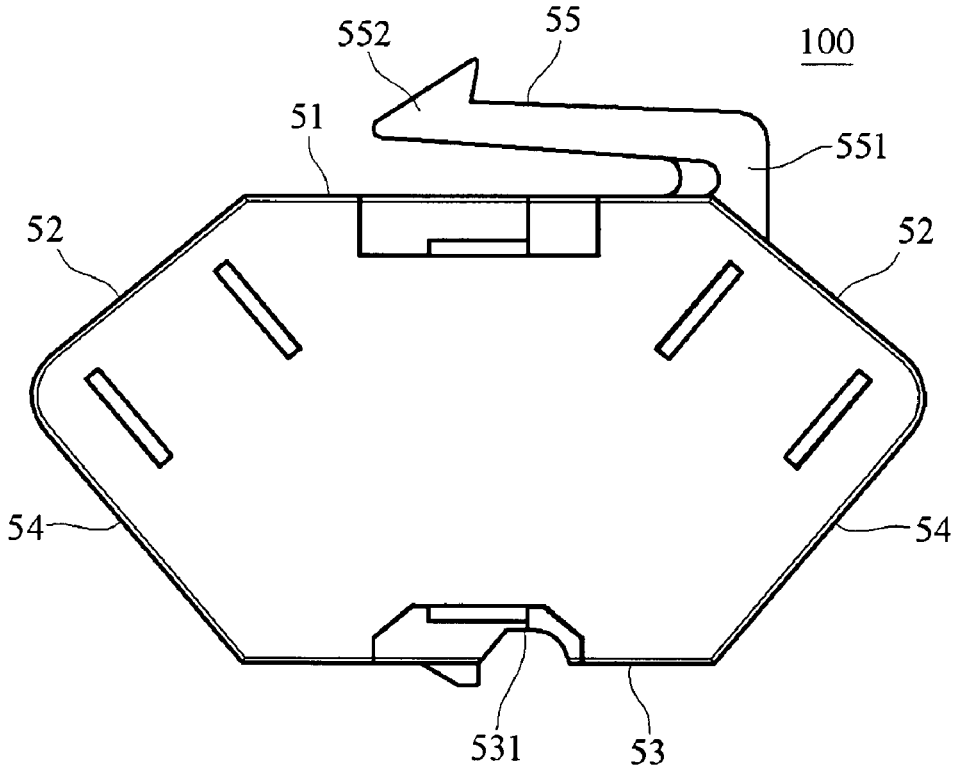
FIG. 5 is a front view of FIG. 3.
Figure 6:
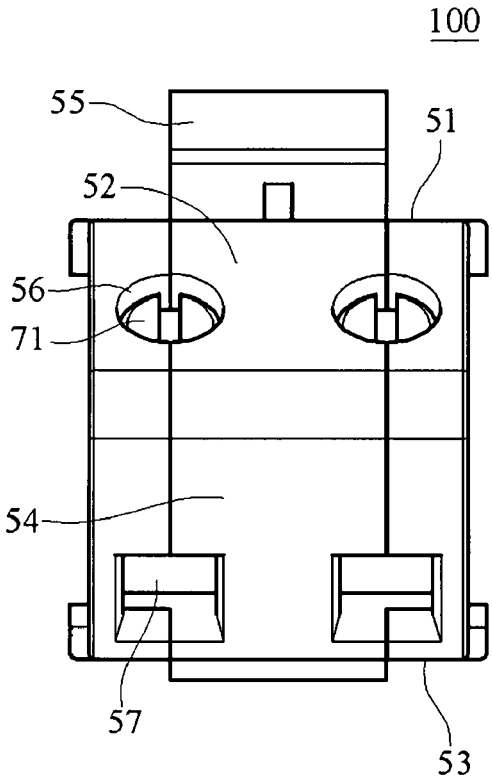
FIG. 6 is a side view of FIG. 3.
Figure 7:
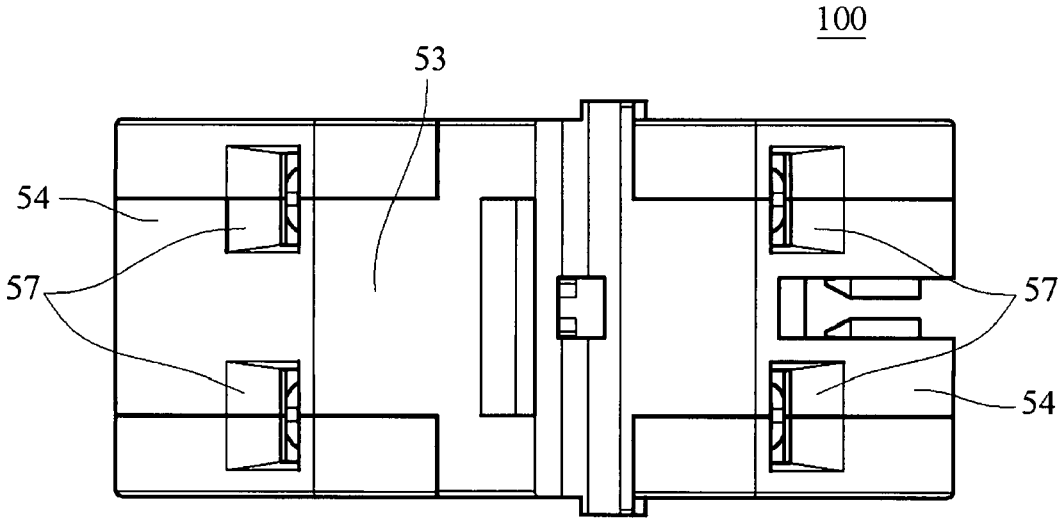
FIG. 7 is a bottom view of FIG. 3.

To make the objective, structure, features, and function of the present invention more understandable, the present invention is illustrated below in detail with reference to the embodiments.

FIGS. 3, 4, 5, 6, 7, 8A, and 8B show a signal line connector 100 according to a first embodiment of the present invention. The signal line connector 100 includes a base 50, a plurality of pressing elements 70, a plurality of conductive elements 60, and a buckle 55.

The base 50 is an irregular polyhedron, having a top surface 51, two top side surfaces 52, a bottom surface 53, and two bottom side surfaces 54. The top surface 51 is opposite to the bottom surface 53, the two top side surfaces 52 extend downward from two opposite sides of the top surface 51 obliquely, and the two bottom side surfaces 54 extend upward from two opposite sides of the bottom surface 53 obliquely. The buckle 55 is disposed on the top surface 51 of the base 50, and includes a base portion 551 and a hook portion 552. One end of the base portion 551 is connected to the base 50 to support the buckle 55. The hook portion 552 is connected to the other end of the base portion 551, and is pressed to bend and deform towards the base 50.

Two openings 56 are arranged in each of the top side surfaces 52 in parallel. However, the number of the openings 56 is not limited by the above description, and can be increased or reduced according to design requirements. A screw 71 of each of the pressing elements 70 is respectively placed into the base 50 through the corresponding opening 56. The bottom side surfaces 54 are opened towards the interior of the base 50, so as to form two sockets 57. The number of the sockets 57 is equal to the number of the openings 56, so as to meet the requirements of the actual design. The openings 56 are respectively in communication with the corresponding sockets 57, and the sockets 57 allow the terminals of the signal lines 80 to be inserted into the base 50. Here, the signal lines 80 can be, but are not limited to, audio cables.

Figure 8A:
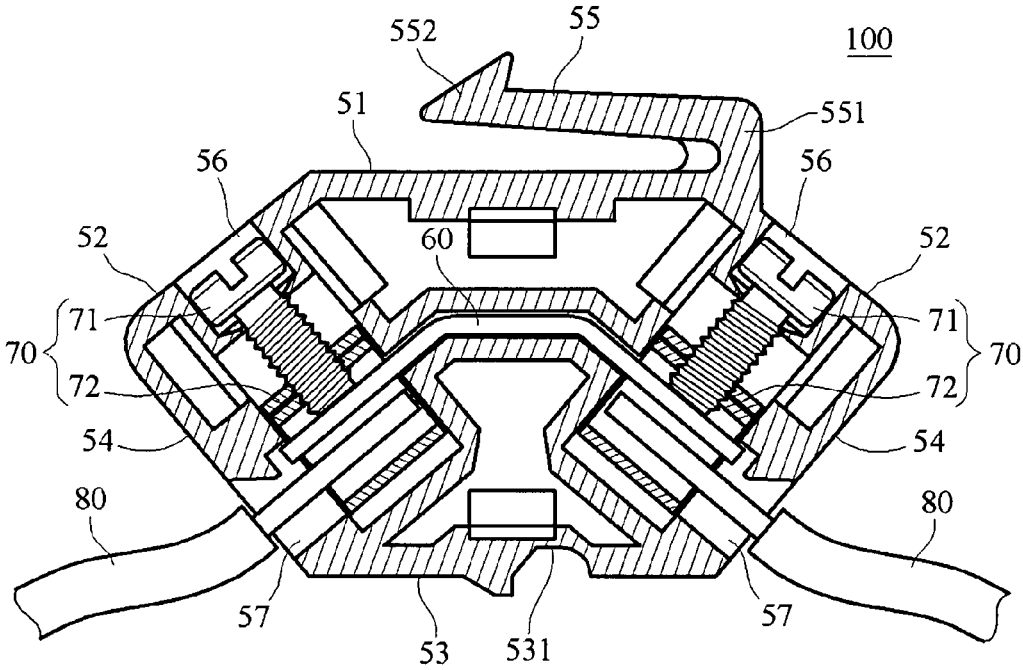
FIG. 8A is a schematic sectional view of the first embodiment, in which the pressing elements remain at the release position.
Figure 8B:
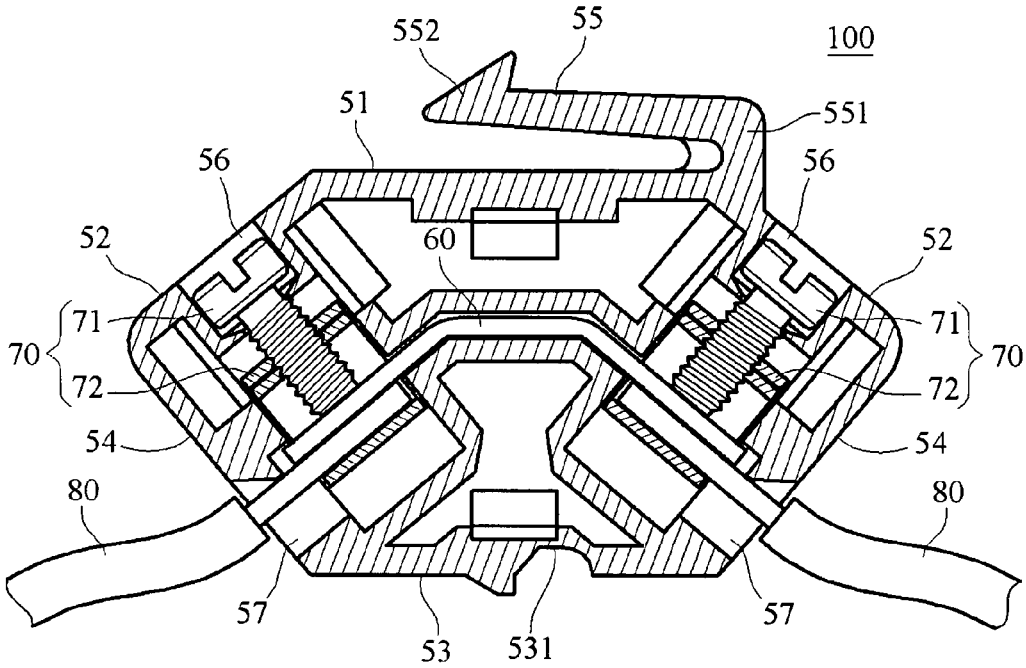
FIG. 8B is a schematic sectional view of the pressing elements of FIG. 8A at the pressing position.

FIGS. 8A and 8B are schematic sectional views of the first embodiment of the present invention. The signal line connector 100 allows the terminals of the two signal lines 80 to be inserted and contact two ends of the conductive elements 60, such that the signal line connector 100 electrically connects the two signal lines 80 via the conductive element 60, and becomes a medium for electrical data transmission between the two signal lines 80. The conductive elements 60 are embedded in the base 50, and two ends of each of the conductive elements 60 are respectively corresponding to the sockets 57. Here, the conductive elements 60 are made of copper or other conductive materials.

The pressing elements 70 are movably disposed in the base 50, and are respectively corresponding to the sockets 57. Each of the pressing elements 70 presses against the terminal of each of the signal lines 80 onto the conductive element 60 at a clamping position (as shown in FIG. 8B), so as to electrically connect the signal lines 80 to the conductive element 60, or insert the terminals of the signal lines 80 between the pressing element 70 and the conductive element 60 at a release position (as shown in FIG. 8A), such that the terminals of the signal lines 80 are separated from the conductive element 60 at the release position.

Moreover, each of the pressing elements 70 includes a screw 71 and a clamping member 72. The screws 71 are placed into the base 50 through the openings 56, and can rotate and move relative to the base 50. The front ends of the screws 71 are located in the base 50. The clamping members 72 are movably disposed in the base 50, and the front ends of the screws 71 are screwed to the clamping members 72. The screws 71 are rotated to drive the clamping members 72 to move relative to the base 50, such that the clamping members 72 move between the clamping position and the release position. The clamping members 72 are frames, two ends of the conductive element 60 are located in the corresponding frames (the clamping members 72), and the terminals of the signal lines 80 pass through the corresponding sockets 57 and are located in the frames (the clamping members 72). The clamping members 72 allow the terminals of the signal lines 80 to be placed into the conductive element 60 at the release position, such that the terminals of the signal lines 80 contact the conductive element 60. The screws 71 can be screwed into the clamping members 72 from the top ends, so as to be rotated to drive the clamping members 72 to move towards the clamping position. Thus, the clamping members 72 press against the terminals of the signal lines 80 onto the conductive element 60, so as to clamp the terminals of the signal lines 80 between the conductive element 60 and the clamping members 72, such that the terminals of the signal lines 80 are tightly attached to the conductive element 60, and the two signal lines 80 are electrically connected.

Figure 9A:
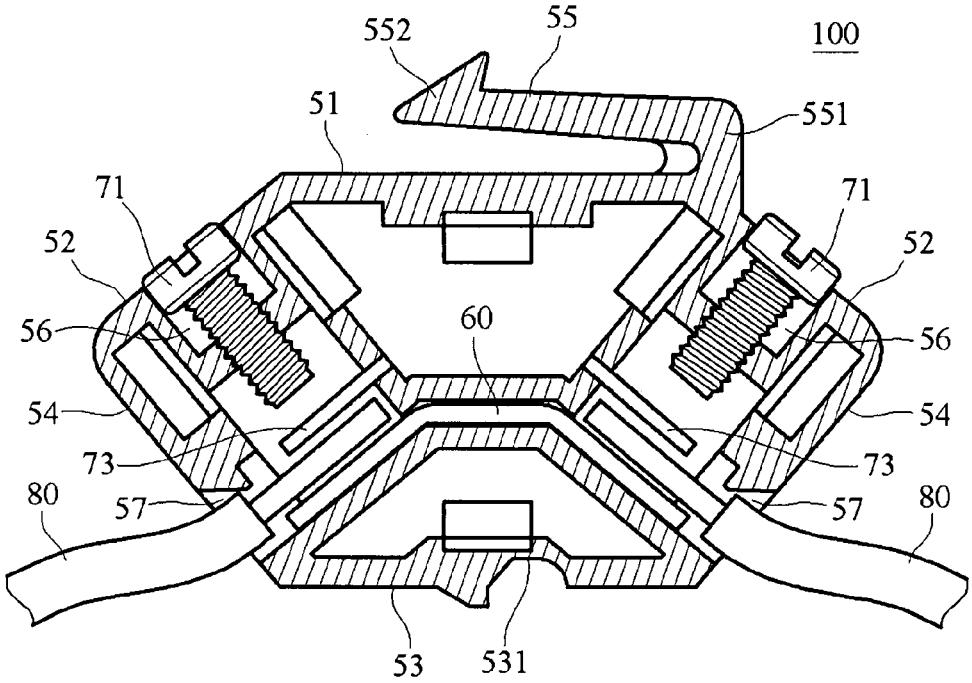
FIG. 9A is a schematic sectional view of the interior of a second embodiment of the signal line connector of the present invention.
Figure 9B:
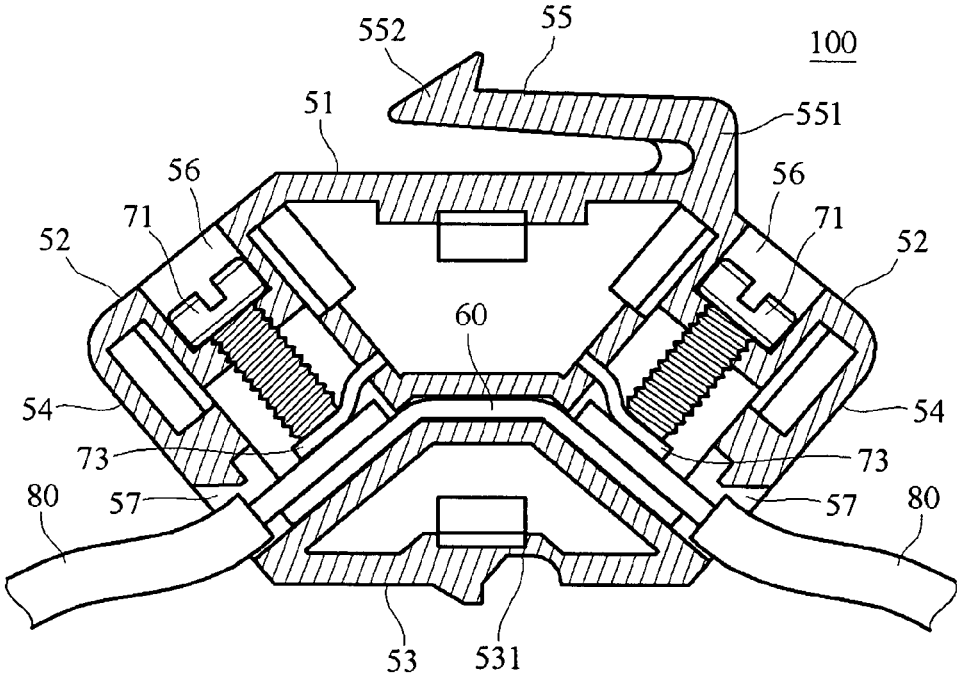
FIG. 9B is a schematic sectional view of the pressing elements of FIG. 9A at the pressing position.

FIGS. 9A and 9B are schematic sectional views of a second embodiment of the present invention. The components of the signal line connector 100 of this embodiment are the same as those of the first embodiment of FIG. 8A, and the difference is that the clamping members 72 of the pressing elements 70 are replaced by elastic springs 73 in the second embodiment. The screws 71 are screwed to the base 50 through the openings 56 to rotate and move relative to the base 50, so as to change the depth of the screws 71 in the base 50. The front ends of the screws 71 abut against one side of the corresponding elastic springs 73 respectively. The elastic springs 73 are embedded in the base 50, and one end of each of the elastic springs 73 suspends and is corresponding to the sockets 57. The screws 714 are rotated to press against the elastic springs 73 to bend and deform to the clamping position (as shown in FIG. 9B) from a release position (as shown in FIG. 9A), such that the terminals of the signal lines 80 are tightly attached to the conductive element 60, and the two signal lines 80 are electrically connected.

As for the signal line connectors 100 disclosed in the above embodiments, the bottom side surfaces 54 on two ends of the base 50 have the sockets 57. A user can insert the terminals of the signal lines 80 into the two corresponding sockets 57 at the release position, and rotate the screws 71 to move the pressing elements 70 to the clamping position. Thus, the front ends of the screws 71 of the pressing elements 70 press against the terminals of the signal lines 80, such that the terminals of the signal lines 80 closely contact the conductive element 60. Moreover, the conductive element 60 electrically connects the two signal lines 80, such that the electrical signals of the two signal lines 80 can be transmitted to one another via the signal line connector 100.

Figure 10:
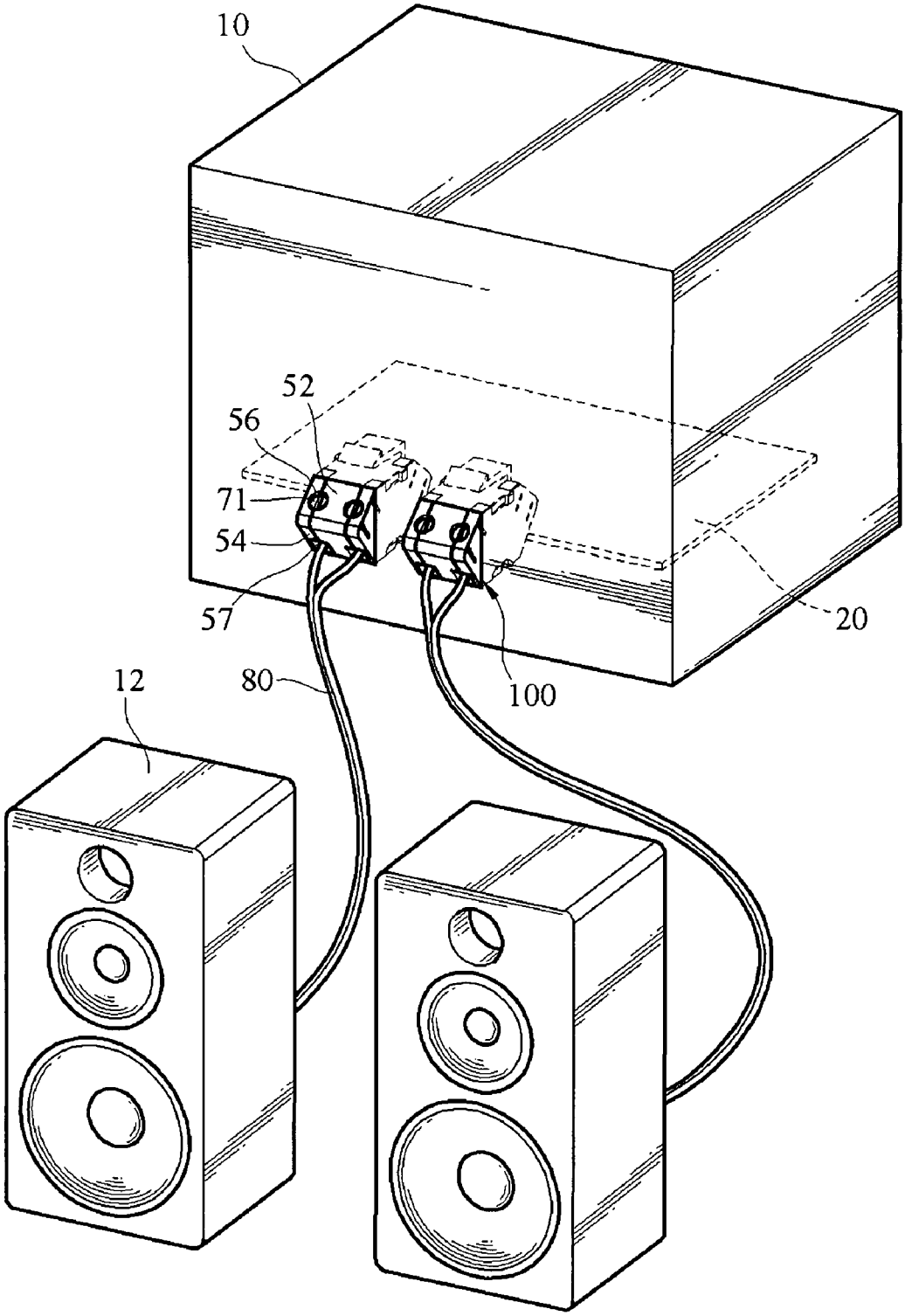
FIG. 10 is a schematic view of the signal line connector of the present invention disposed on the main audio unit.

According to the disclosure of FIG. 10, when the signal line connector 100 of the present invention is disposed on a main audio unit 10, the circuit board 20 is connected to one side of the signal line connector 100 through the signal lines 80, and one side of the signal line connector 100 exposed outside the main audio unit 10 allows the signal lines 80 of the speakers 12 to insert and connect, so as to output the electrical signals of the circuit board 20 to the speakers 12. Thus, the signal line connector 100 does not need to be connected to the circuit board of the main audio unit 10 by soldering, which improves the flexibility of internal design and arrangement of the main audio unit 10 greatly.

Figure 11:
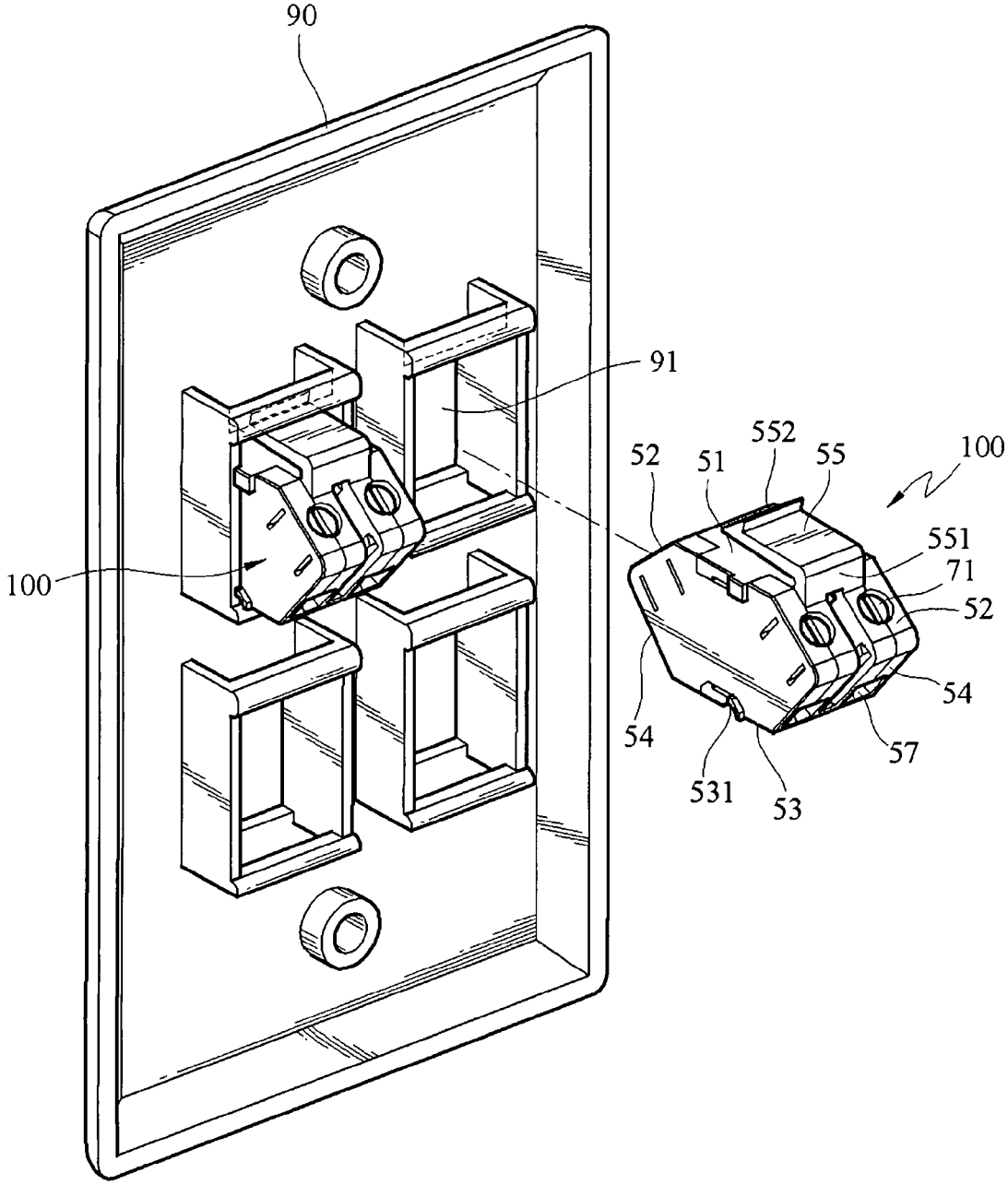
FIG. 11 is a schematic isometric view of the signal line connector of the present invention embedded in the signal connection base.
Figure 12:
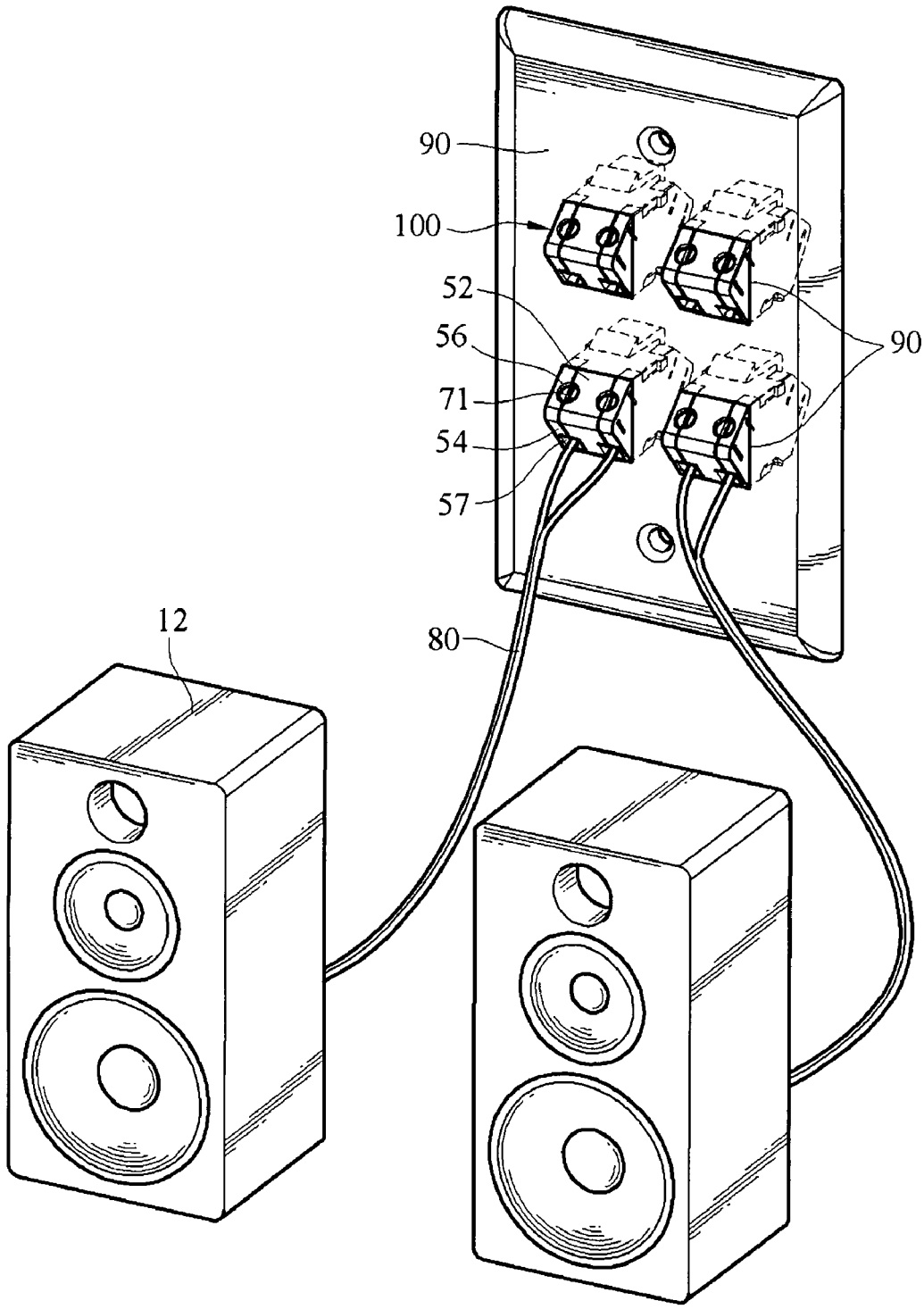
FIG. 12 is a schematic view of the signal line connector of the present invention connected to the speakers with the audio cables after being disposed in the signal connection base.

As shown in FIGS. 11 and 12, the base 50 can use the buckle 55 and a recess portion 531 in the bottom surface 53 to be inserted and buckled to a matching buckling slot 91 in a signal connection base 90. The operation mode is as follows. The recess portion 531 in the bottom surface 53 of the base 50 abuts against one side of the buckling slot 91 first, and then the base 50 is pushed into the buckling slot 91. The hook portion 552 of the buckle 55 will contact the other side of the buckling slot 91, and is pressed by the buckling slot 91 to bend and deform slightly towards the base 50, so as to further push the base 50. Thus, the hook portion 552 enters the buckling slot 91, and the base 50 and the hook portion 552 are inserted and buckled in the buckling slot 91, such that the openings 56, the sockets 57, and the screws 71 on one side of the signal line connector 100 are exposed outside the signal connection base 90, and the signal lines 80 are inserted into the speakers 12 to connect the speakers 12. The signal line connector 100 is disposed inside the signal connection base 90, and can be directly used with the wires arranged in the walls of a building. Thus, the user can place the speakers 12 at a position where the signal connection base 90 is arranged in the building, so as to enhance the flexibility of the position to place the sound source output device, and to improve the convenience to install and disconnect the sound source output device subsequently.

Figure 13A:
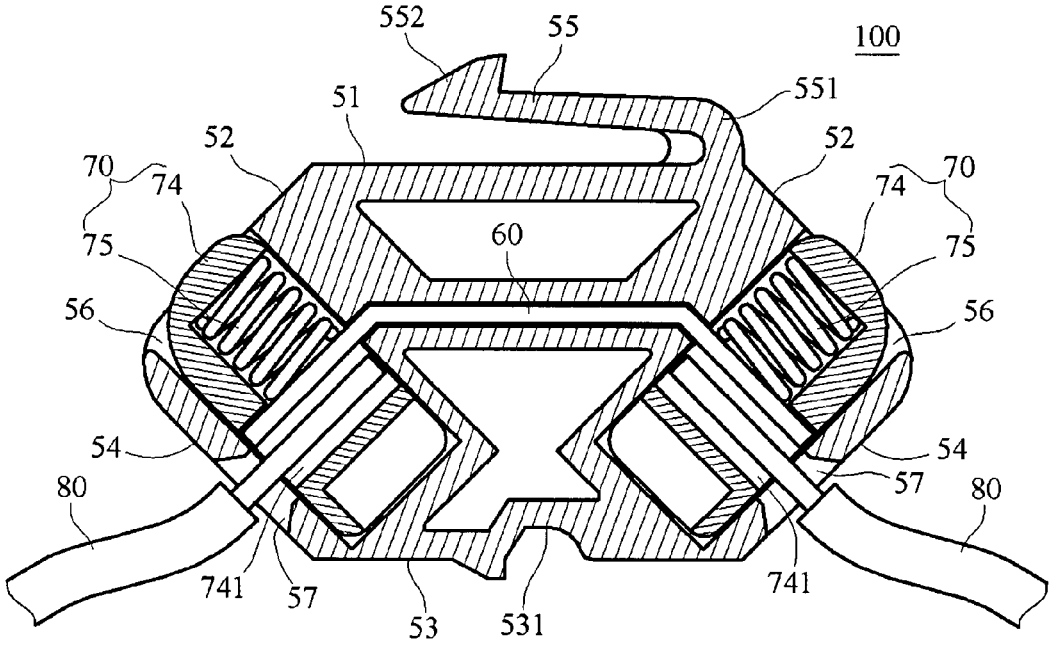
FIG. 13A is a schematic sectional view of a third embodiment, in which the pressing elements remain at the release position.
Figure 13B:
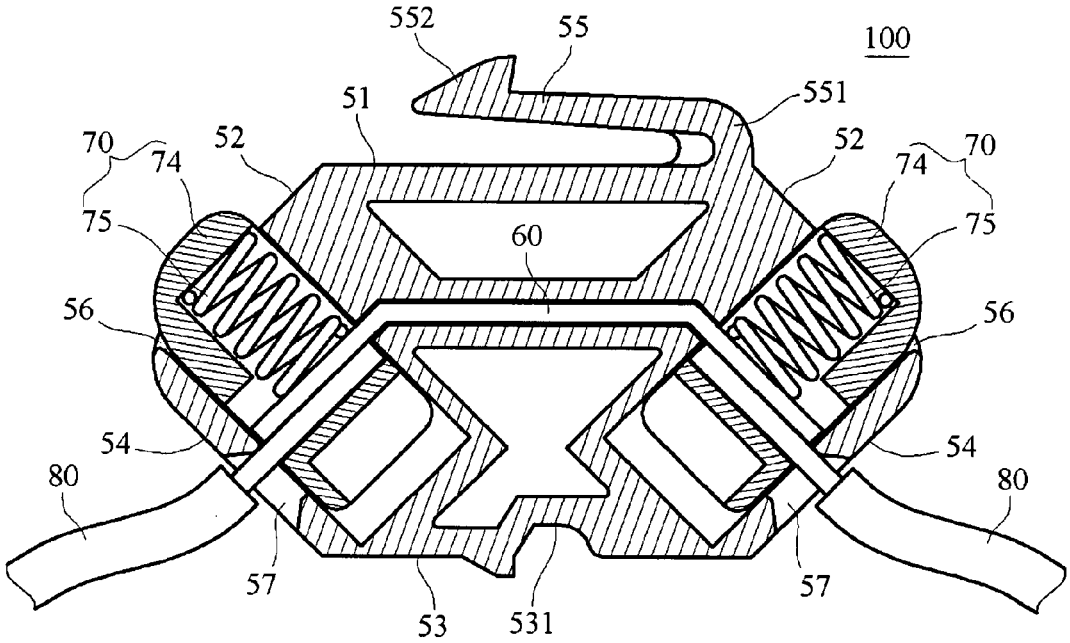
FIG. 13B is a schematic sectional view of the pressing elements of FIG. 13A at the clamping position.

FIGS. 13A and 13B are schematic sectional views of a third embodiment of the present invention. The signal line connector 100 of this embodiment is implemented to be the same as the first embodiment substantially, while the difference is that each of the pressing elements 70 includes a pressing member 74 and an elastic element 75. Each of the pressing members 74 is a shell having a clamping hole 741, and each of the elastic elements 75 can be a compression spring.

The pressing members 74 are movable disposed in the base 50, and are corresponding to the sockets 57. The pressing members 74 protrude from the base 50 through the openings 56, two ends of the conductive element 60 are inserted into the clamping holes 741 of the corresponding pressing members 74, and the terminals of the signal lines 80 also pass through the corresponding sockets 57 to be inserted into the clamping holes 741. The elastic elements 75 are disposed in the pressing members 74, one end of each of the elastic elements 75 abuts against the conductive element 60, and the other end thereof abuts against the pressing members 74. The elastic elements 75 push the pressing members 74 to move towards a clamping position (as shown in FIG. 13B) constantly, such that the pressing members 74 press against the terminals of the signal lines 80 onto the conductive element 60. The pressing members 74 are constantly located as the clamping position, and can be pressed by an external force to compress against the elastic elements 75, such that the pressing members 74 move from the clamping position to a release position (as shown in FIG. 13A). At this time, the terminals of the signal lines 80 are inserted into the pressing members 74 to electrically contact the conductive element 60. When the applied external force is removed, the elastic elements 75 provide an elastic recovery force, which drives the pressing members 74 to move from the release position to the clamping position, so as to force the pressing members 74 to clamp the terminals of the signal lines 80 and contact and tightly attach the conductive element 60. Thus, the terminals of the signal lines 80 can be rapidly inserted into the base 50 and be clamped without using additional hand tools, such that the two signal lines 80 electrically connect the conductive element 60.

Figure 14A:
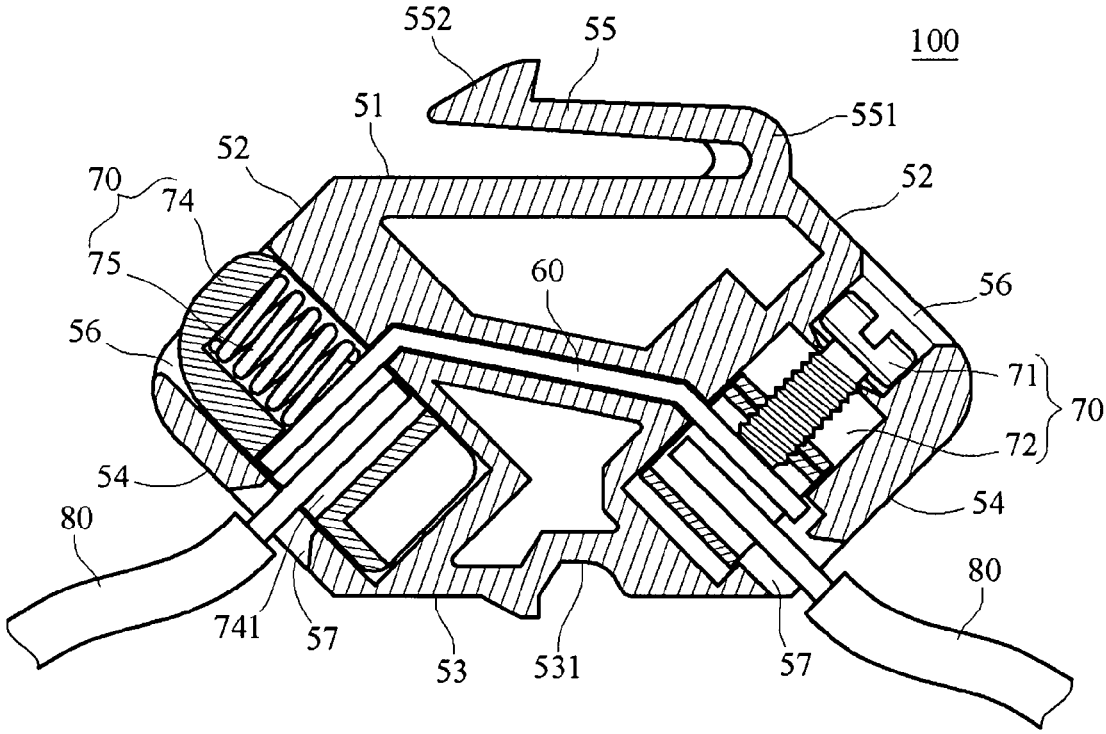
FIG. 14A is a schematic sectional view of the fourth embodiment, in which the pressing elements remain at the release position.
Figure 14B:
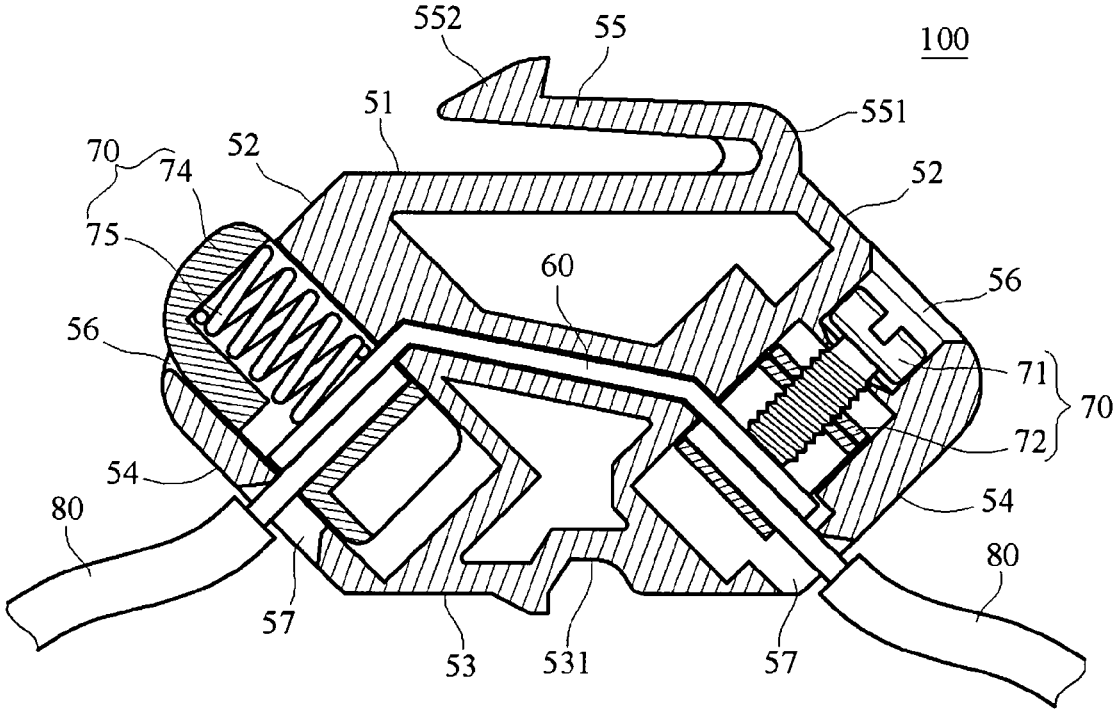
FIG. 14B is a schematic sectional view of the pressing elements of FIG. 14A at the clamping position.

FIGS. 14A and 14B are schematic sectional views of the fourth embodiment of the present invention. This embodiment integrates the first embodiment and the third embodiment, in which the pressing elements 70 on one side of the signal line connector 100 include the screws 71 and the clamping members 72 of the first embodiment, and the pressing elements 70 on the other side of the signal line connector 100 include the pressing members 74 and the elastic elements 75 of the third embodiment. The structures and motion modes of the two kinds of pressing members 70 are the same as the above embodiments, and will not be described herein.

In view of the above, the signal line connector 100 of the present invention not only improves the tolerance of the internal design of the sound source device, reduces the number of exposed wires in the room, and beautifies the indoor environment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A signal line connector, applied between output terminals and input terminals of signal lines for electrically connecting the output terminals and the input terminals, the signal line connector comprising:

a base having a first socket for receiving the output terminals of the signal lines and a second socket for receiving the input terminals of the signal lines;

a conductive element having two ends, embedded in the base, wherein the two ends of the conductive element are respectively corresponding to the first and second sockets; and two pressing elements, movably disposed in the base, each pressing element corresponding to one of the first and second sockets, both of the two pressing elements alternatively being at a clamping position and at a release position, wherein when both of the two pressing elements are selectively moved at the clamping position, the output terminals of the signal lines and the input terminals of the signal lines are respectively pressed onto one end of the conductive element by one of the two pressing elements, so as to respectively electrically connect the output terminals of the signal lines with the conductive element and connect the input terminals of the signal lines with the conductive element, thereby transmitting electrical signals from the input terminals to the output terminals, and when both of the two pressing elements are selectively moved at the release position the output terminals of the signal lines and the output terminals of the signal lines are separated from the conductive element;

wherein at least one of the pressing elements on one end of the conductive element comprises: a screw, disposed in the base, and rotatable relative to the base, wherein a front end of the screw is located in the base; and a clamping member, movably disposed in the base, wherein the front end of the screw is screwed to the clamping member, and the screw is moved rotatably to move the clamping member between the release position and the clamping position, such that the output terminals of the signal lines and the input terminals of the signal lines are respectively pressed onto the conductive element by the clamping member when both of the two pressing elements are moved at the clamping position; and wherein the other of the pressing elements on the other end of the conductive element comprises: a pressing member, movably disposed in the base and corresponding to the other socket, wherein the pressing member protrudes from the base, such that the pressing member is pressed and moves from the clamping position to the release position relative to the base, and an elastic element sandwiched between the pressing member and the conductive member for pushing the pressing member to constantly move towards the clamping position, such that the pressing member presses one terminal of the other signal lines onto the conductive element.

2. The signal line connector as claimed in claim 1, wherein the base further has at least one opening in communication with the corresponding one of the first and second sockets, and the screw of the pressing element is placed into the base through the at least one opening.

3. The signal line connector as claimed in claim 1, wherein the clamping member is a frame, one end of the conductive element is located in the frame, and each of the output terminals of the signal lines and the input terminals of the signal lines respectively passes through each of the first and second sockets located in the frame.

* * * * *